United States Patent [19]

Wolpert, Jr. et al.

[11] Patent Number: 4,593,422

[45] Date of Patent: Jun. 10, 1986

[54] TELESCOPING WING NUT CLAMPING UNIT

[75] Inventors: George H. Wolpert, Jr., Columbia; Albert E. Sebest, Lancaster, both of Pa.

[73] Assignee: Spectro Industries, Inc., Jenkintown, Pa.

[21] Appl. No.: 518,641

[22] Filed: Jul. 29, 1983

[51] Int. Cl.[4] ..... A47C 31/00; A44B 21/00

[52] U.S. Cl. ..... 5/503; 24/525; 248/229; 248/231.5; 403/105; 403/377

[58] Field of Search ..... 5/507, 508, 503, 445, 5/81 R; 248/445, 229, 226.2, 345.1, 615; 108/107; 211/182; 312/348; 403/377, 378, 105, 329; 269/232, 233, 234; 24/524, 525, 569

[56] References Cited

U.S. PATENT DOCUMENTS

| | | | |
|---|---|---|---|
| 915,187 | 3/1909 | Kingston . | |
| 1,320,613 | 11/1919 | Gilcrease | 403/105 |
| 1,440,783 | 1/1923 | Kiley | 248/345.1 |
| 1,470,706 | 10/1923 | Day . | |
| 1,987,399 | 1/1935 | Harris | 24/524 |
| 2,408,801 | 10/1946 | Miller | 144/305 |
| 2,548,248 | 4/1951 | Wiebe | 24/525 |
| 2,550,365 | 4/1951 | McKenzie | 24/525 |
| 2,607,881 | 8/1952 | Anderson | 240/4.2 |
| 2,755,681 | 7/1956 | Merriman | 74/424.8 |
| 2,812,789 | 11/1957 | Hutson | 144/305 |
| 3,030,639 | 4/1962 | Boyer | 5/327 |
| 3,077,713 | 2/1963 | Mayer | 5/317 |
| 3,157,931 | 11/1964 | McKeown | 24/569 |
| 3,425,681 | 2/1969 | Wing | 269/182 |
| 3,535,751 | 10/1970 | Batchelor | 24/525 |
| 3,565,380 | 2/1971 | Langren | 5/503 |
| 3,606,391 | 9/1971 | Sinnott | 24/525 |
| 3,835,861 | 9/1974 | Kees | 403/105 |
| 3,899,149 | 8/1975 | Schneider | 248/229 |
| 4,103,927 | 8/1978 | Schmidt | 403/377 |
| 4,240,170 | 12/1980 | Thumberger et al. | 5/445 |
| 4,253,207 | 3/1981 | Marcyan | 5/445 |

FOREIGN PATENT DOCUMENTS

| | | | |
|---|---|---|---|
| 610261 | 11/1948 | United Kingdom | 248/229 |
| 987314 | 3/1965 | United Kingdom | 24/525 |

*Primary Examiner*—Gary L. Smith
*Assistant Examiner*—Vinh Luong

[57] ABSTRACT

A clamping device is provided having a stabilizing plate, a retainer shaft cooperating with the stabilizing plate which includes a ratchet end, an elbow and clamp, twisting means for tightening the clamp, and quick release ratchet means to allow an object to be quickly secured between the plate and clamp and movably riding over the ratchet, which clamping device can act cooperatively with a mast to form a bed trapeze securing device.

18 Claims, 6 Drawing Figures

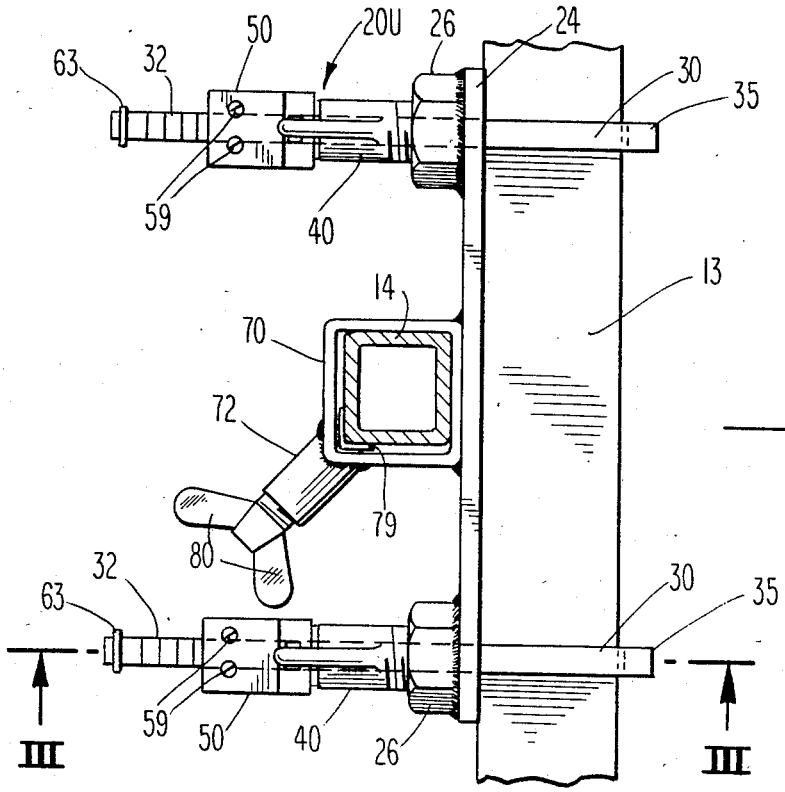
Fig. 2
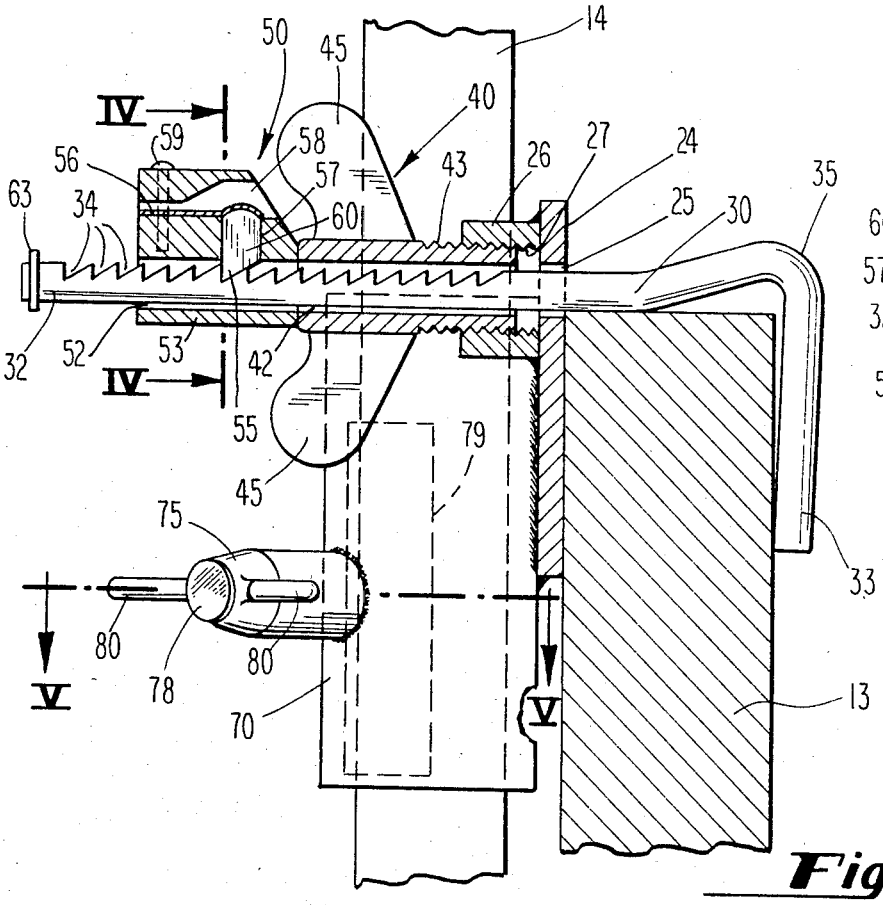
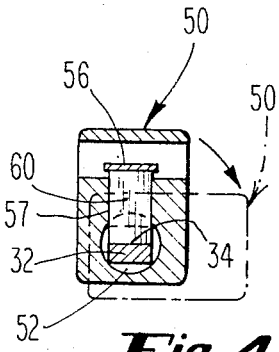
Fig. 4
Fig. 3

TELESCOPING WING NUT CLAMPING UNIT

BACKGROUND OF THE INVENTION

This invention relates to a device for attaching a trapeze-anchoring structure to a hospital bed, and more particularly, to a clamping device to allow the trapeze-anchoring structure or other similar structure to be clamped onto the bedboard of the bed.

In adjusting trapeze clamping structures to hospital beds, to allow the patients to maintain some exercise activity while still confined to the bed, it is very often the case that two or even three attendants are required to control all of the pieces. The trapeze structure is both long and awkward, and because it extends out over the mattress from the headboard, it causes pressure to bear on the top part of the fixture that is used to clamp the structure to the headboard. A common way of tightening the clamping fixture onto the headboard is to use a clamping arrangement wherein a bolt is tightened on a nut thereby clamping the headboard and securing the anchoring-structure. This oftentimes involves laborious rotating of the bolt inside the clamp in one direction to clear the headboard, and then laborious rotating of the bolt in the opposite direction to engage the work and tighten the clamp. All of these movements consume considerable time and effort and make it very inconvenient at certain times to attempt to adjust the trapeze on the headboard.

One such example of this type of device is in U.S. Pat. No. 3,077,613 to E. H. Mayer. That invention shows a boom extending from a swivel post which in turn is clamped to the top of the headboard by a pair of helical screw C-clamps and fixed by a single C-clamp to the bottom of the headboard.

Another device used to attach objects to a headboard of a hospital bed is shown in the U.S. Pat. No. 2,607,881 to J. M. Anderson. This invention has a clamping device which fits over the rail of the headboard. It has a pair of oppositely disposed arms extending from the top rail, which are held together by a pair of helical thumb screws. Devices of this nature are awkward to work with since the thumb screws must be rotated all the way back to allow open space for the clamping device to fit over the headrail, and then rotated all the way close to secure the device upon the headboard.

SUMMARY OF THE INVENTION

A quick release ratchet clamping device to be used to attach various fixtures, such as a mast for a trapeze and boom to a bed is disclosed. The device has retainer shafts with ratchet slots cut into the end that are pushed through a stabilizing plate. A quick-release mechanism rides on the shafts and employs a wedge-shaped tooth that is pressed into an individual slot to halt rearward movement. A hollow wing-bolt is forced against the release mechanism to tighten the clamp against the bedboard.

Accordingly, it is an object of the present invention to provide a trapeze clamping device, for use on a hospital bed headboard, which will save considerable time and labor in the adjustment thereof.

It is a further object of the invention to provide a clamping device which is simple yet reliable in operation.

It is a still further object of the invention to provide a clamping device which will accommodate a variety of headboards.

These and other objects and many of the attendant advantages of this invention will be readily appreciated as the same becomes better understood by reference to the following detailed description when considered in connection with the accompanying drawings and appended claims, wherein:

A BRIEF DESCRIPTION OF THE FIGURES

FIG. 2 shows a plan view of the upper half of the clamping device of the present invention taken along lines II—II of FIG. 1;

FIG. 3 shows a side elevation view taken along lines III—III of FIG. 2;

FIG. 4 shows an end elevation view taken along lines IV—IV of FIG. 3;

DESCRIPTION OF THE PREFERRED EMBODIMENT

Figure 1:
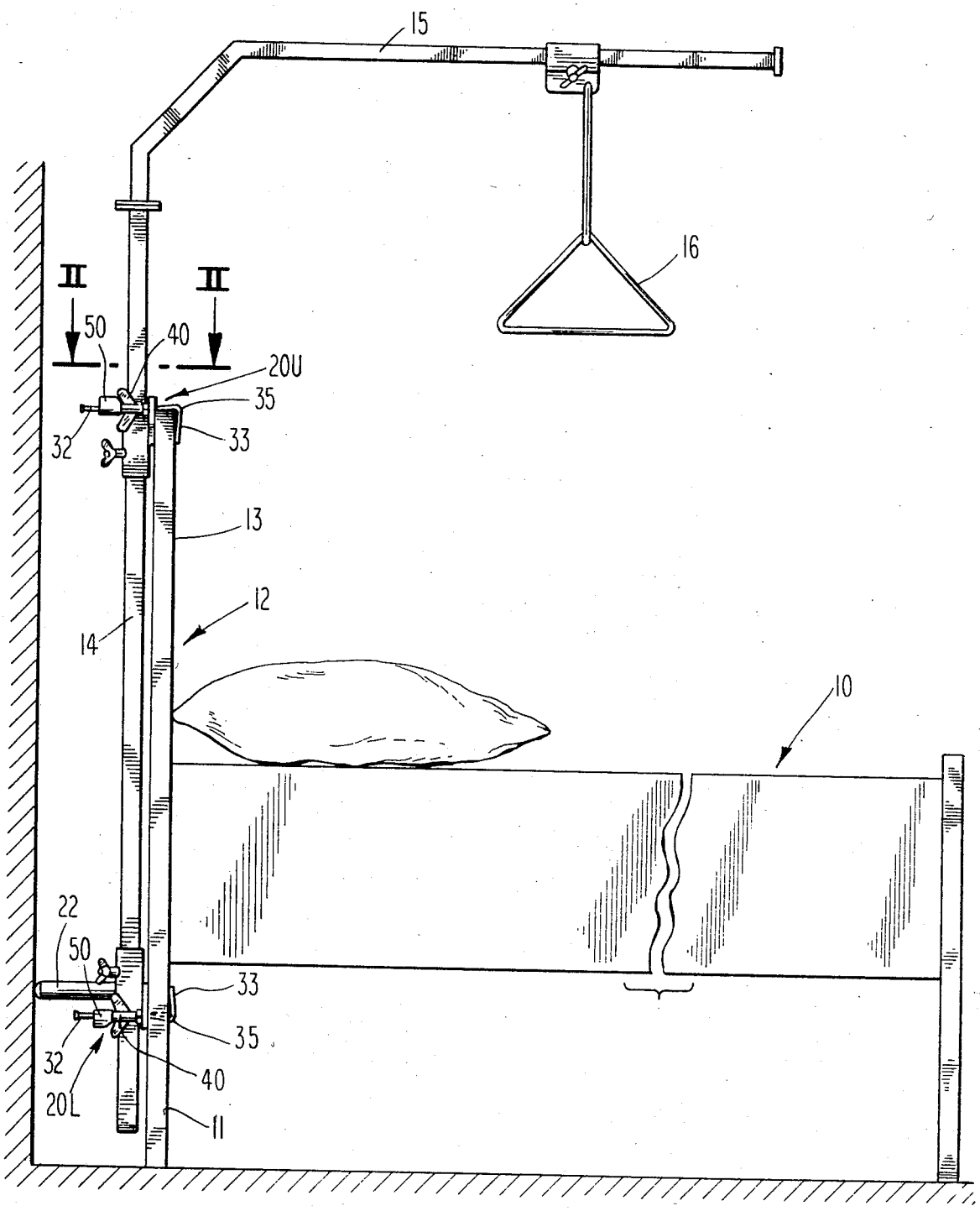
FIG. 1 shows a side elevation view of the invention installed on the headboard of a bed.

FIG. 1 shows the current invention installed on a bed 10, which could be a hospital bed. The bed has a standard headboard 12 at the head thereof, which consists of a solid piece 13, with optional rails (not shown) over the top edge and bottom edge, and two short legs 11 to rest on the floor. In one form of the invention, an upper half clamping device 20U is provided to attach to the upper edge or railing of the headboard and a lower half clamping device 20L is provided to attach to the lower edge of the headboard. As seen in FIG. 1, a mast 14 extends between the upper and lower halves of clamping device 20 in a parallel manner to the headboard and provisions are made for a boom 15 and a trapeze 16 to further extend from mast 14. With this arrangement, a patient lying in the bed, has the use of the trapeze to either hoist himself up or suspend a leg or arm in a cast. Since the invention herein described will be used in either a hospital or convalescent environment, stainless steel or some such other suitable material would be used to make the various parts herein described.

FIG. 2 shows a plan view taken along lines II—II of FIG. 1 and shows the upper half of the clamping device 20U attached to a headboard. It should be noted from the outset that the upper half and the lower half of the clamping device are similar to one another except for a wall guide 22 that is attached to the lower half 20L and for the inverted arrangement of retainer shafts. Wall guide 22 is an important element of clamping device 20 because it prevents a bed that the device is being used on from being pushed against a hospital wall and thereby crushing or damaging any of the individual parts of the device.

FIG. 3 shows a side elevation view taken along lines III—III of FIG. 2. FIG. 4 shows an end elevation taken along lines IV—IV of FIG. 3. FIGS. 2, 3 and 4 will be used to help describe the invention in more detail. In describing the invention, the term "forward" means to the right as viewing the figures, and "rearward" means to the left as viewing the figures.

As seen in FIGS. 2 and 3, the invention is constructed on a stabilizing plate 24 that is placed against headboard 13 of the bed or other device that is going to have the structures attached thereto. Stabilizing plate 24 is a flat plate of predetermined dimensions and of a strong and sturdy, but lightweight material, that has a plurality of orifices 25 bored therethrough. At the backside surface of stabilizing plate, a wing nut 26 is permanently affixed to stabilizing plate 24 so that its bore is centered around each orifice 25 in plate 24. As can be seen in FIG. 3, each wing nut has a set of helical threads 27 on the inside surface.

A retainer shaft 30, having a ratchet end 32, is inserted through each orifice 25 in plate 24, and wing nut 26 so that ratchet end 32 extends toward the rear of the clamping device 20 and a clamp end 33 can extend over headboard 14 as illustrated in FIGS. 2 and 3. Retainer shaft 30 is built of a sturdy, stainless steel material and has a predetermined number of ratchet slots 34 cut into the upper surface or spine of shaft 30 at predetermined intervals and at a predetermined slot angle. An elbow 35 of an angle of approximately 90° is formed in shaft 30 before it ends in clamp end 33. The length from elbow 35 backwards to the rear of the ratchet end 32 is of a predetermined length to allow retainer shaft 30 to fit over headboards of various thicknesses. The dimensions of clamp end 33 are of a predetermined dimension to allow clamp end 33 to curl down over headboard 13 to a distance approximately equal to the width of stabilizing plate 24. In addition, padding (not shown) can be arranged around clamp end 33 to prevent any marring or scratching of the surface of headboard 13.

After retainer shaft 30 is inserted through orifice 25 stabilizing plate 24 and wing nut 26, a wing bolt 40 and a quick release catch 50 are sequentially inserted on said shaft. Both wing bolt 40 and quick release catch 50 have a bore extending longitudinally therethrough (42 and 52, respectively), which bore is of sufficient diameter to allow easy movement of retainer shaft 30 therethrough. On the outside of the front end of wing bolt 40 there are helical threads 43 cut into the surface to match threads 27 on the inside of wing nut 26. As can be seen in FIGS. 2 and 3, wing bolt 40 can be turned in a clockwise direction to matingly engage threads 27 on the inside surface of wing nut 26 and thereby advance toward the headboard. Conversely, as wing bolt 40 is rotated in a counterclockwise direction (as viewed from the rear), the bolt will retract itself from wing nut 26. Wing bolt 40 is of such a construction so as to have a pair of large leaf-shaped wings 45 extending from opposite points at its head so as to allow easy grasping by the hand of someone attaching clamping device 20 to a bedboard. As seen in the preferred embodiment shown in FIG. 2, there are two retainer shafts 30 for clamping each half of device 20 onto a bedboard, however, more or less could be used.

As seen in FIGS. 3 and 4, quick release catch 50 is constructed of a release body 53, a release cap 54, a wedge-shaped tooth 55 and a leaf-spring 56, all of predetermined dimensions. The construction of release body 53 is generally in the form of a rectangular block with bore 52 extending longitudinally through the lower one-half as previously described. The size of bore 52 is of a larger diameter than the size of retainer shaft 30 and as seen in FIG. 4 is of a circular shape. Retainer shaft 30 is constructed in a generally square shape having ratchet slots 34 extending along the upper surface for a predetermined distance. Quick release body 53 has a perpendicular opening 57 down to bore 52 towards the front thereof, and wedge-shaped tooth 55 is inserted in opening 57 so that it will extend down into bore 52.

Body 53 is constructed to have ridges 58 on either side thereof with a slot 61 throughout the middle to allow leaf-spring 56 to extend from the back to the front thereof. Body cap 54 is fitted over leaf-spring 56 and quick release body 53 and secured thereto with two small machine screws 59, or other fastening devices, near the rear end of quick release body 53 to position leaf-spring 56 such that the front end of spring 56 maintains constant pressure over the top of tooth 55. In this manner, tooth 55 is constantly urged downward into an individual ratchet slot 34. The bottom end of the tooth is shaped such that it has a vertical surface 60 and a slanted surface 62 of the same angle as the ratchet slots 34 are constructed. As seen in FIG. 4, the width of tooth 55 is generally the same as the width of the top surface of retainer shaft 30. After quick release catch 50 is fed over retainer shaft 30, a stop, in the form of a small washer 63, is affixed to the very back end of retainer shaft 30 for a purpose to be described below.

Figure 5:
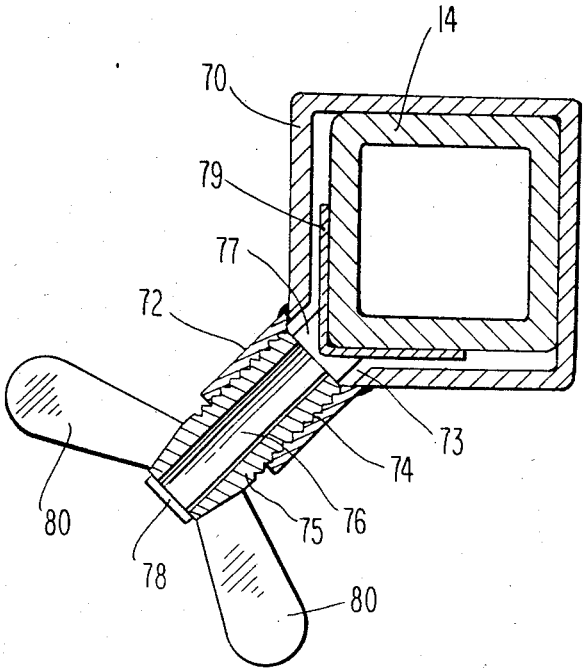
FIG. 5 shows a plan view taken along lines V—V of FIG. 3.

As seen in FIG. 2, stabilizing plate 24 has a collar 70 permanently affixed to both upper and lower halves thereof. As shown in FIG. 2, collar 70 is in the form of a square; however, other shapes such as a circle or a rectangle, could easily be used. FIG. 5 shows a plan view of collar 70 as seen from lines V—V of FIG. 3. Collar 70 has a collar outlet 72 with a bore 73 therethrough extending from the inside to the outside with helical threads 74 cut into the inside surface of said bore. A hollow wing bolt 75 is matingly threaded to threads 74 and carries throughout its longitudinal length a straight shaft 76 to apply pressure against a mast. The shaft at both the front and rear ends has a blocking piece attached thereto. Front piece 77 fits against a corner 79 which jams against mast 14. At the opposite end of shaft 76, rear piece 78 is a cap on the outside of the end of wing bolt. As wing bolt 76 is turned by use of wings 80, rear piece 78, shaft 76 and front piece 77 are moved accordingly.

In accordance with the invention, the operation of clamping device 20 is started by placing upper and lower stabilizing plates 24 against headboard 13 so that orifices 25 in plate 24 extend above and below the edges of the headboard and so that collars 70U and 70L are aligned. Ratchet end 32 of retainer shafts 30 is inserted through orifices 25 so that clamp 33 comes to rest in the position shown. Wing bolt 40 is fed over the extending ratchet end 32 and threaded into threads 27 inside wing nut 26. Quick release catch 50 is inserted over ratchet end 32 and washer 63 placed on the very end of shaft 30. Once quick release catch 50 is inserted onto ratchet end 32, tooth 55 will catch in a ratchet slot 34. If the motion of quick release catch 50 is forward, the slants in the individual ratchet slot 34 and the slant 62 in the leading edge of tooth 55 allow tooth 55 to ride up against pressure from leaf-spring 56 until the next individual ratchet slot is reached. With this action, quick release catch 50 is urged forward along ratchet end 32 to abut the rear end of wing bolt 40. This motion forces clamp end 33 to press headboard 13 against stabilizing plate 24 with sufficient pressure to keep clamping device 20 in place. Wings 45 are now twisted counterclockwise and wing bolt 40 is urged rearward against pressure of quick release catch 50. Quick release catch 50 is firmly engaged to resist any pressure of wing bolt 40 because the rear vertical surface 60 of tooth 55 is caught against the vertical edge of the individual ratchet slot 34. In this manner, wings 45 can be twisted counterclockwise approximately one-half to three-quarters of a turn and clamp end 33 is forced back with an even greater pressure against the surface of headboard 13. More or less pressure can be exerted on headboard 13 by twisting wings 45 more or less.

Once upper half 20U and lower half 20L of the clamping device are inserted on bedboard 13, mast 14 is inserted into upper 70U and lower 70L collars. Before mast 14 is inserted in collars 70, collar-wings 80 are rotated counterclockwise thereby moving blocking piece 79 away from the center of the collar. After mast 14 is inserted, wings 80 are rotated clockwise and blocking piece 79 is caused to jam against mast 14 thereby securing same inside collar 70. Trapeze boom 15 and trapeze 16 can then be secured to mast 14.

Removal of mast 14 and clamping device 20 is accomplished by reversing the above procedure. Wings 80 are rotated counterclockwise and pressure is removed from mast 14. Mast 14 is removed from both the upper 70U and lower 70L collars. Quick release catch 50 is twisted one-quarter of a turn to right or left, as seen in phantom in FIG. 4, thereby removing tooth 55 from the individual ratchet slot that it was forced against. The pressure maintained by leaf-spring 56 is not so great as to prohibit tooth 55 from riding up slightly as quick release catch 50 is turned. Tooth 55 will force back against pressure exerted by leaf spring 56 and slide along the smooth side surfaces of ratchet end 32 of retainer shaft 30. In this manner, quick release catch 50 is moved very quickly to the rear of retainer shaft 30 thereby removing any pressure from the rear end of wing bolt 26. Pressure is now removed from between clamp end 33 and headboard 13, and clamp end 33 can be pulled through orifice 25 and stabilizing plate 24 to give enough room for it to be lifted off of headboard 13.

As mentioned above, upper and lower halves of device 20 are operated in the same manner. Wall guide 22 is fixedly attached to lower half 20L so as to project horizontally from collar 70L. Wall guide 22 is made of a sturdy material and of a predetermined length, and may alternately have a cushion (not shown) on the end thereof.

Figure 6:
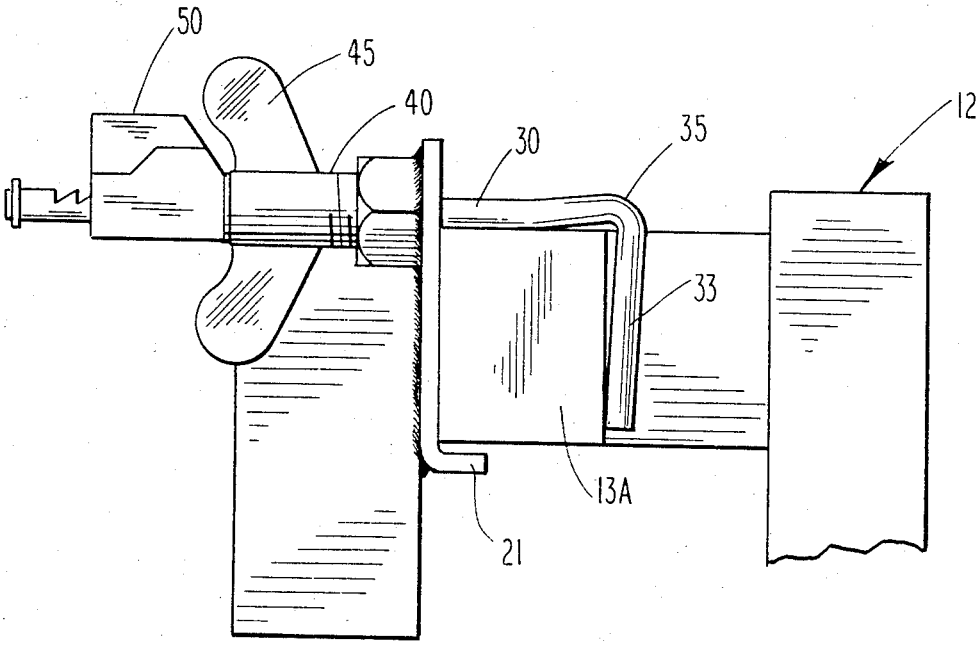
FIG. 6 shows a side elevation view, similar to the view of FIG. 3, of an alternate embodiment of the upper half of the clamping device of the current invention.

FIG. 6 shows an alternate embodiment of the invention. It has been found that some beds do not have a solid headboard but rather are constructed with a framework-type bedboard. For these beds, a modification is made to stabilizing plate 24. Plate 24 is formed with a ledge or lip 21 extending forwardly at a right angle so as to seat itself under top rail 11, or, on the bottom, over the bottom rail (not shown). This modification allows the invention herein described to fit on all known headboards.

What is claimed is:

1. A bed trapeze securing device comprising stabilizing means engaging a bedboard for providing a stable base for said device; mast holding means fixed to said stabilizing means for securing a mast for holding a trapeze; and a quick-release ratchet clamp means connected through said stabilizing means for securing said stabilizing means to said bedboard wherein said quick-release ratchet clamp means further includes at least one retainer shaft extending through said stabilizing means, said shaft having a ratchet end, an elbow and a clamp end, twisting means engaging said stabilizing means and with a central bore therethrough to allow passage of said retainer shaft for precise tightening of said ratchet clamp means, and quick-release means slidable on said ratchet end and for releasably grasping said ratchet end and providing a stop for said twisting means.

2. A device as in claim 1 wherein said mast holding means comprises an upper and lower collar for accepting said mast therein and pressure means extending through said collars for releasably securing said mast.

3. A device as in claim 2 wherein said pressure means comprises:

an outlet through the side of the collar, said outlet having helical screw threds on the inner surface thereof;

a hollow bolt matingly threaded to said inner surface threads;

a shaft disposed throughout the length of said bolt and having a stop at the head and foot thereof for contactingly riding with said bolt as said bolt is turned; and a blocking piece adjacent said mast connected at said foot stop for releasably jamming said mast.

4. A device as in claim 3 wherein said bolt is a wing-bolt having wings at the head for turning.

5. A device as in claim 1 wherein said quick-release means comprises:

a release body having a bore therethrough from the back to the front so as to allow sliding movement over said ratchet end;

tooth means for releasably catching in an individual ratchet slot located inside said body near the front end thereof extending into said bore; and compression means secured inside said body and forcing against said tooth means so as to maintain adjustable pressure on said tooth means.

6. A device as in claim 5 wherein said tooth means is a wedge-shaped tooth with a slanted face thereof so as to slide over said ratchet only in the forward direction.

7. A device as in claim 5 wherein said compression means is a leaf spring.

8. A device as in claim 1 wherein said twisting means comprises:

a nut with a bore therethrough having helical screw threads on the surface of said bore and being fixedly attached to said stabilizing means; and a hollow wing-bolt with a bore therethrough and having helical screw threads around the outer surface thereof for matingly engaging said nut threads.

9. A bed-trapeze securing device which cooperates with a mast comprising:

a pair of stabilizing plates for placing against the upper and lower ends of a bedboard;

a collar fixed to each said plate, each said collar having a. an outlet through the side thereof, said outlet having helical screw threads on the inner surface thereof, b. a hollow wing-bolt matingly threaded to said inner surface threads, c. a shaft disposed throughout the length of said wing-bolt and having a stop at the head and foot thereof for contactingly riding with said bolt as said bolt is turned, and d. a blocking piece connected at said foot stop for releasably jamming said mast as said wing-bolt is turned in a clockwise direction;

at least two retainer shafts with a rearward ratchet end, an elbow, and a forward clamp end extending through orifices in said stabilizing plates, each of said retainer shafts having a release body with a bore therethrough to accommodate said shaft so as to allow sliding and twisting movement over said ratchet end, with said body containing a wedge-shaped tooth located therein near the front thereof and extending into said bore for releasably catching in an individual ratchet slot and a leaf spring secured therein near the rear thereof so as to maintain pressure on said tooth; and a nut with a bore therethrough having helical screw threads on the surface of said bore and being fixedly attached to said plate at said orifice and a wing-bolt with a bore therethrough and having helical screw threads around the outer surface thereof for matingly engaging said nut threads.

10. A clamping device comprising:

a stabilizing plate to be placed against an item to be clamped;

a retainer shaft extending through an orifice in said plate and having a rearward ratchet end, an elbow and a forward clamp end;

twisting means for precise tightening of said clamp end attached to said plate and with a central bore therethrough to allow passage therethrough by said shaft; and quick-release ratchet means for allowing an object to be quickly secured between said plate and said clamp and movably riding over said ratchet end of said retainer shaft.

11. A device as in claim 10 wherein said twisting means comprises:

a nut having helical threads and being fixedly attached to said plate; and a wing-bolt with a bore therethrough and having helical threads around the outer surface thereof for matingly engaging said nut threads.

12. A device as in claim 11 wherein said quick-release ratchet means comprises:

a release body with a bore therethrough to accommodate said shaft so as to allow sliding and twisting movement over said shaft;

a wedge-shaped tooth located inside said body near the front thereof and extending into said bore for releasably catching an individual ratchet slot; and a leaf-spring secured inside said body near the rear thereof so as to maintain pressure on said tooth.

13. A clamping device comprising:

a stabilizing plate to be placed against an item to be clamped;

at least one retainer shaft extending through an orifice in said plate and having a rearward ratchet end, an elbow, and a forward clamp end;

a nut having helical threads attached to said plate to allow passage therethrough by said shaft;

a wing-bolt with a bore therethrough and having helical threads around the outer surface thereof for matingly engaging said nut threads;

a release body with a bore therethrough to accommodate said shaft so as to allow sliding and twisting movement over said shaft;

a wedge-shaped tooth located inside said body near the front thereof and extending into said bore for releasingly catching an individual ratchet slot; and a leaf spring secured inside said body near the rear thereof so as to maintain pressure on said tooth.

14. A clamping device comprising first and second retainer means for engaging an object to be clamped, said first retainer means having an orifice through which said second retainer means extends, wherein said first retainer means includes stabilizing means engaging said object and forming a portion of said orifice, twisting means for adjustably engaging said stabilizing means and forming a portion of said orifice, and ratchet means for movably engaging and quickly releasing from engagement of said second retainer means whereby said clamping device may be quickly disengaged from said object by disengaging said ratchet means.

15. A clamping device as in claim 14, wherein said ratchet means further includes engagement means for engaging said second retainer means and pressure means for urging said engagement means into contact with said second retainer means.

16. A clamping device as in claim 15, wherein said second retainer means further includes ratchet end means on a portion thereof for permitting forward but not rearward movement of said ratchet means when said engagement means contacts said ratchet end means and permitting rearward movement when said engagement means contacts the other portion of said second retainer means and is thus disengaged from said ratchet end means.

17. A clamping device in claim 16, wherein said ratchet end means comprise a plurality of ratchet slots and said engagement means comprise a tooth having an end having a rearward vertical surface and a forward slanted surface of the same angle as said ratchet slots.

18. A clamping device as in claim 16, wherein said ratchet means further includes stop means for said twisting means whereby said twisting means is adjusted to engage both said stabilizing means and said stop means for precise tightening of said clamp means.

* * * * *